United States Patent [19]

Ogura

[11] Patent Number: 4,539,906

[45] Date of Patent: Sep. 10, 1985

[54] HAND-HELD PRINTER

[75] Inventor: Mitsuru Ogura, Nara, Japan

[73] Assignee: Sharp Kabushiki Kaisha, Osaka, Japan

[21] Appl. No.: 237,486

[22] Filed: Feb. 23, 1981

[30] Foreign Application Priority Data

| | | | |
|---|---|---|---|
| Feb. 23, 1980 | [JP] | Japan | 55-22098 |
| Feb. 23, 1980 | [JP] | Japan | 55-22099 |
| May 30, 1980 | [JP] | Japan | 55-73931 |

[51] Int. Cl.[3] ..... B41J 1/20

[52] U.S. Cl. ..... 101/93.14; 101/111; 101/110

[58] Field of Search ..... 101/99, 95, 96, 110, 101/111; 400/88, 146

[56] References Cited

U.S. PATENT DOCUMENTS

| | | | |
|---|---|---|---|
| 3,353,648 | 11/1967 | Amada et al. | 101/110 X |
| 3,504,622 | 4/1970 | Morrison | 101/111 X |
| 3,604,348 | 9/1971 | Price | 101/111 |
| 3,630,143 | 12/1971 | Price | 101/111 X |
| 3,793,951 | 2/1974 | Denley | 101/111 |
| 3,884,144 | 5/1975 | Shimodaira | 101/110 X |
| 3,973,111 | 8/1976 | Washizuka et al. | 400/88 X |
| 4,075,945 | 2/1978 | Bienholz | 101/111 |
| 4,191,104 | 3/1980 | Okabe | 400/146 X |

*Primary Examiner*—Edward M. Coven

*Attorney, Agent, or Firm*—Birch, Stewart, Kolasch & Birch

[57] ABSTRACT

A hand-held printer such as an electronic numbering machine includes a plurality of type carrying belts or a plurality of type wheels. A drive system is associated with the type carrying belts or the type wheels to rotate the type carrying belts (type wheels) in a forward direction. A type selection system is provided for each type carrying belt (type wheel) for stopping the rotation of the type carrying belt (type wheel) when a desired type reaches a preselected position suited for the following type impact operation. After completion of the type selection operation, the type carrying belts (type wheels) are driven to swing in a predetermined direction, whereby the selected types make contact with a print receiving paper. After completion of the type impact operation, the type carrying belts (type wheels) are driven to swing in the counter direction and to rotate in a reverse direction for returning the printer to the initial stand-by condition.

10 Claims, 19 Drawing Figures

HAND-HELD PRINTER

BACKGROUND AND SUMMARY OF THE INVENTION

The present invention relates to a printer and, more particularly, to a mechanical construction in a handheld printer.

It is highly requested that a hand-held printer of a simple construction be provided, which can print desired information on a desired paper.

Accordingly, an object of the present invention is to provide a hand-held printer of a simple construction.

Another object of the present invention is to provide a hand-held printer wherein the type selection operation and the type depressing operation are automatically performed.

Still another object of the present invention is to provide an electronically controlled numbering machine which prints desired numbering information on a desired paper.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit of the invention will become apparent to those skilled in the art from this detailed description.

To achieve the above objects, pursuant to an embodiment of the present invention, a desired type mounted on a type carrying belt is selected while the type carrying belt is driven to rotate in a first direction. Then, the type carrying belt is swung around a shaft so that the selected type makes contact with a copy paper disposed below the printer. After completion of the actual printing operation, the type carrying belt is returned to its initial position, and the types mounted on the type carrying belt are reset to their initial position while the type carrying belt is driven to rotate in a second direction counter to the first direction. The above-mentioned type selection operation and the swinging operation are performed while a drive motor rotates one round.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
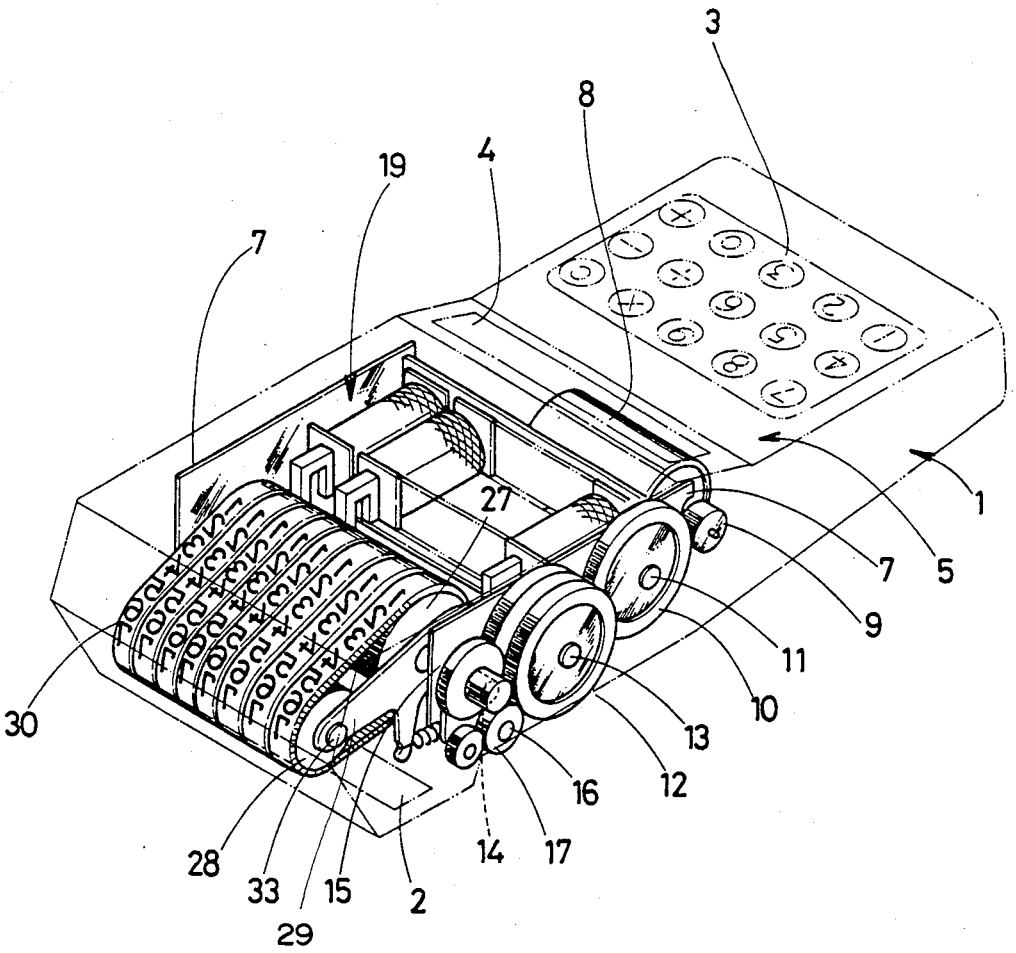
FIG. 1 is a perspective view of an embodiment of a hand-held printer of the present invention.

FIG. 1 shows an embodiment of a hand-held printer of the present invention, which includes a type carrying belt.

A housing 1 includes a control panel 5 including a keyboard panel 3 for introducing a desired data into the printer, and a digital display unit 4 for displaying the data to be printed. A printer mechanism section is disposed in the front section of the housing 1, and an aperture 2 is formed in the bottom wall of the housing 1 through which the printer section makes contact with a print paper disposed below the hand-held printer.

The printer mechanism section comprises a motor, motor rotation transfer means, a type carrying belt, a type belt driving wheel, and a stopper for stopping the rotation of the type belt driving wheel.

A motor gear 9 is fixed to a drive shaft of a motor 8. An idle gear 10 is geared to the motor gear 9, the idle gear 10 being rotatably supported by a pin 11 secured to a frame 7. A cam gear 12 is geared to the idle gear 10, the cam gear 12 being rotatably supported by a pin 13 secured to the frame 7. A drive wheel gear 15, which is secured to a drive wheel shaft 14, is geared to the cam gear 12. A reset gear 17, which is rotatably supported by a pin 16 secured to the frame 7, is geared to the cam gear 12 and the drive wheel gear 15.

The cam gear 12 comprises one full gear and two partial gears. The drive wheel gear 15 comprises one full gear and one partial gear. More specifically, the cam gear 12 is geared to the idle gear 10 via the full gear included in the cam gear 12. The drive wheel gear 15 is geared to the cam gear 12 through the use of one of two partial gears included in the cam gear 12 and the partial gear included in the drive wheel gear 15. Further, the reset gear 17 is geared to the cam gear 12 via the other partial gear included in the cam gear 12.

These gears function to selectively transfer the rotation of the motor 8 to the drive wheel shaft 14. At the side wall of the full gear included in the cam gear 12, a cam groove is formed to conduct a swinging operation of the printer mechanism section, thereby contacting selected types to a print paper disposed below the aperture 2.

A plurality of drive wheels 27 are supported by the drive wheel shaft 14 in a manner such that each of the drive wheels 27 is independently controlled to stop its rotation. A plurality of idle wheels 28 are rotatably supported by a pin 33 so that each of the idle wheels 28 confronts the corresponding drive wheel 27. The pin 33 and the drive wheel shaft 14 are coupled with each other via a lever 29. A plurality of type carrying belts 30 extend between the corresponding drive wheels 27 and idle wheels 28 so that the type carrying belt 30 rotates in response to the rotation of the drive wheel 27. A pin is fixed to the other end of the lever 29, the pin being accomodated in the above-mentioned cam groove formed in the side wall of the full gear included in the cam gear 12, whereby the idle wheels 28 and the type carrying belts 30 are driven to swing around the drive wheel shaft 14 in response to the rotation of the cam gear 12. That is, the print impact operation is conducted through the use of the rotation of the cam gear 12.

An electromagnetic control system 19 is disposed at the back of the type belt mechanism for selectively stopping the rotation of the drive wheels 27 and releasing the locking condition of the drive wheels 27 in response to a control signal derived from a control system included in the hand-held printer. That is, the electromagnetic control system 19 functions to select a desired type mounted on the type carrying belt 30. The electromagnetic control system 19 is provided in a number corresponding to the number of type carrying belts 30.

The actual printing operation is conducted in the following manner. First, the motor 8 begins to rotate, and the drive wheel shaft 14 begins to rotate. When a desired type reaches a preselected position corresponding to the print position, the electromagnetic control system 19 functions to stop the rotation of the drive wheel 27. Thereafter, the type belt mechanism is swung in the counter-clockwise direction in FIG. 2 around the drive wheel shaft 14 in response to the rotation of the cam gear 12. Thus, the selected type makes contact with the print paper through the aperture 2. After completion of the contacting operation, the type belt mechanism is swung in the clockwise direction around the drive wheel shaft 14 in response to the rotation of the cam gear 12. At the same time, the reset gear 17 is geared to the cam gear 12 to return the type carrying belt 30 to its initial position suited for the next type selection operation. The above-mentioned sequence of the one cycle operation is performed while the motor 8 rotates one round. It will be clear that a drive signal for the motor 8 and a control signal to be applied to the electromagnetic control system 19 are derived from a central processor control unit disposed in the hand-held printer.

Figure 2:
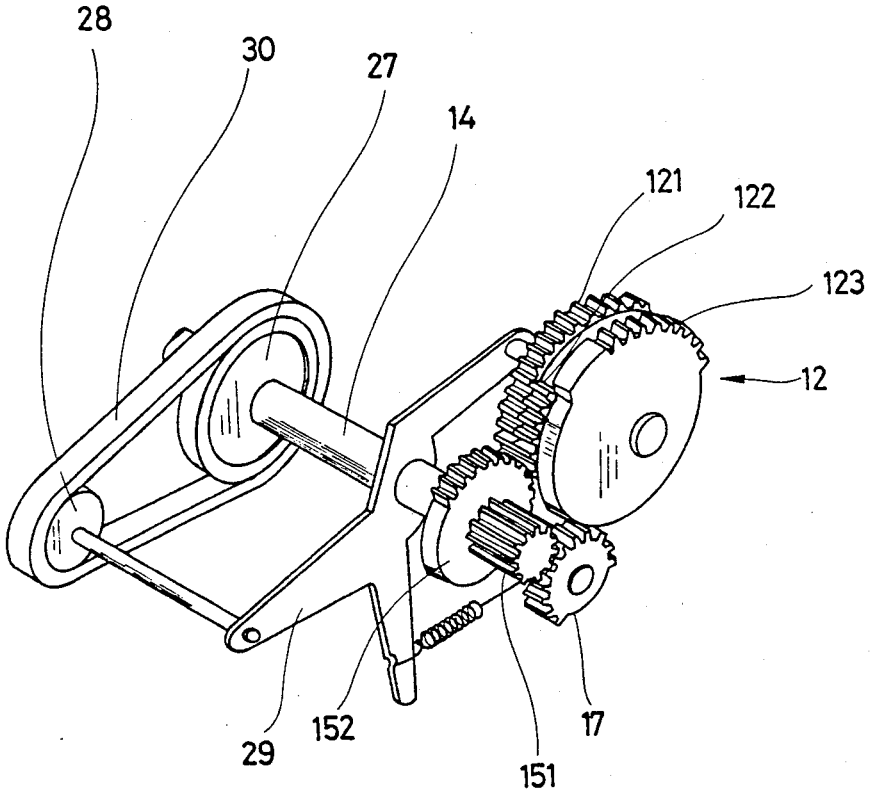
FIG. 2 is a perspective view showing the relationship between a cam gear and a drive gear included in the handheld printer of FIG. 1.

FIG. 2 shows the relationship between the cam gear 12 and the drive wheel gear 15. The cam gear 12 comprises a composite gear including a full gear 121, a partial gear 122, and another partial gear 123. The drive wheel gear 15 comprises a composite gear including a full gear 151, and a partial gear 152. The partial gear 152 is located at a position to be geared to the partial gear 122.

In the initial stand-by condition, all of the drive wheels 27 are held at the home position. In this case, the partial gear 122 and the partial gear 152 are geared to each other for preparing the rotation of the drive wheels 27. The reset gear 17 is not geared to the partial gear 123. The geared sections of the partial gears 122 and 152 have a length suited for rotating the drive wheel shaft 14 by one round. And, the non-geared sections of the reset gear 17 and the partial gear 123 have a length corresponding to that of the geared sections of the partial gears 122 and 152. The geared sections of the reset gear 17 and the partial gear 123 have a length required for rotating the drive wheel shaft 14 by one round. When the reset gear 17 is geared to the partial gear 123, the partial gear 122 is not geared to the partial gear 152.

Figure 3:
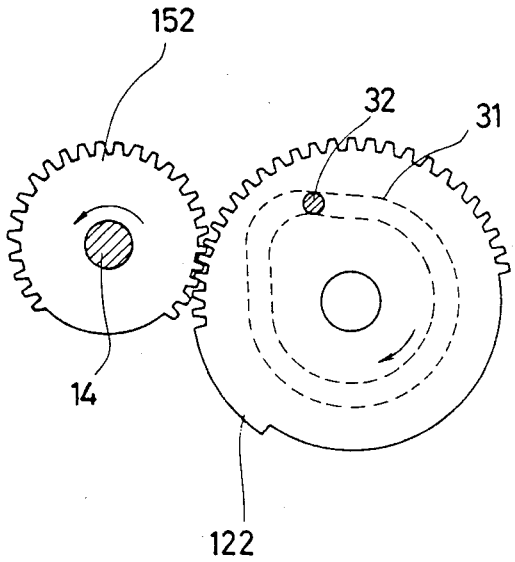
FIGS. 3(A) and 3(B) are side views for explaining the operation modes of the cam gear and the drive gear of FIG. 2.
Figure 3:
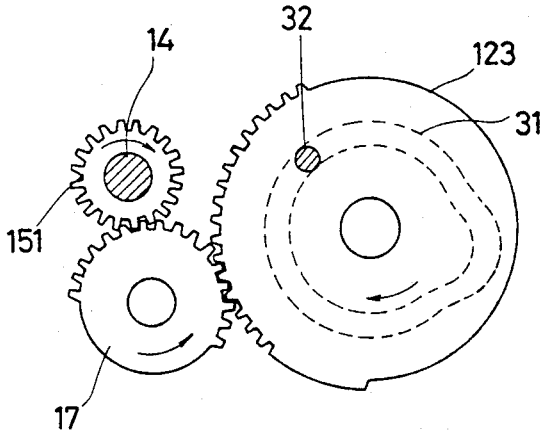

Accordingly, when the partial gear 152 included in the drive wheel gear 15 is geared to the partial gear 122 included in the cam gear 12, the drive wheel shaft 14 is driven to rotate in the forward direction as shown in FIG. 3(A). Contrarily, when the reset gear 17 is geared the the partial gear 123 included in the cam gear 12, the drive wheel shaft 14 is driven to rotate in the reverse direction as shown in FIG. 3(B). FIGS. 3(A) and 3(B) also show the coupling condition between the pin 32 fixed to the lever 29 and the groove 31 formed in the side wall of the full gear 121 included in the cam gear 12. That is, FIG. 3(A) shows a condition just before the lever 29 performs the swinging operation, and FIG. 3(B) shows a condition where the lever 29 is driven to swing upward.

Figure 4:
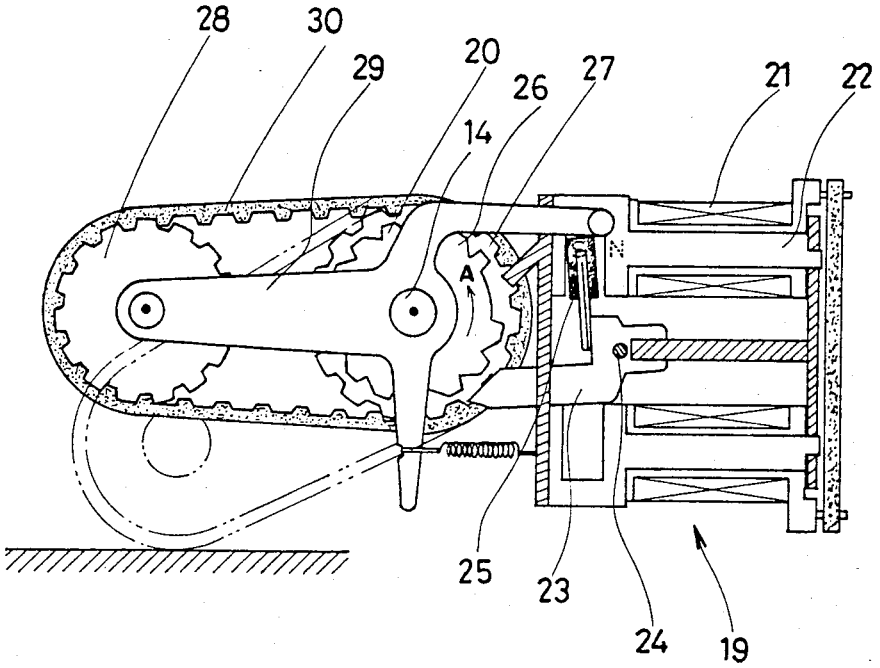
FIG. 4 is a sectional view showing the relationship between a type carrying belt mechanism and an electromagnetic control system included in the hand-held printer of FIG. 1.

FIG. 4 shows a type selection mechanism. The solid line in FIG. 4 shows the initial stand-by condition. The drive wheel 27 has a click portion 20, and the drive wheel 27 is rotatably supported by the drive wheel shaft 14 through the use of the click portion 20. In the normal rotation mode, the drive wheel 27 rotates in unison with the rotation of the drive wheel shaft 14. However, when the rotation of the drive wheel 27 is precluded by a suitable member, the drive wheel shaft 14 slides within the click portion 20 without transferring the rotation operation to the drive wheel 27.

The electromagnetic control system 19 comprises an electromagnetic coil 21, an iron core 22, and an L-shaped lever 23. The lever 23 is rotatably supported by a pin 24. At one end of the lever 23, a magnet piece 25 is fixed which cooperates with the electro-magnetic coil 21. More specifically, when the iron core 22 is magnetized, the lever 23 is rotated in the clockwise direction in FIG. 4. In the magnetized condition, the front end of the iron core 22 functions as the N-pole. The rear end of the magnet piece 25 functions as the S-pole. The arm portion of the L-shaped lever 23 has a length to reach the click portion 20 of the drive wheel 27. When the iron core 22 is magnetized and the lever 23 is rotated in the clockwise direction, the tip end of the lever 23 catches the click portion 20. The click portion 20 includes a protruded portion 26 for releasing the click portion 20 from the tip end of the lever 23 when the click portion 20 is driven to rotate in the reverse direction, namely, in the clockwise direction.

The above-mentioned electro-magnetic control system 19 is provided in a number corresponding to the number of the drive wheels 27. The plurality of the electro-magnetic control systems 19 are aligned along the drive wheel shaft 14 in two rows, thereby minimizing the space occupied by the electro-magnetic control systems 19.

When the motor 8 begins to rotate, the drive wheel shaft 14 is driven to rotate in the forward direction as shown by an arrow A in FIG. 4. The drive wheels 27 rotate in unison with the rotation of the drive wheel shaft 14. Thus, the type carrying belts 30 rotate in accordance with the rotation of the drive wheels 27. When a desired type carried by the type carrying belt 30 reaches a preselected position suited for the following print operation, an electric current is applied to the electromagnetic coil 21 to magnetize the iron core 22. The lever 23 is rotated in the clockwise direction to catch the click portion 20, thereby stopping the rotation of the drive wheel 27 without regard to the rotation of the drive wheel shaft 14. Accordingly, the type carrying belt 30 is held in a condition where a desired type is located at the preselected position. The above-mentioned type selection operation is conducted for each of the type carrying belts 30, independently, before the drive wheel shaft 14 rotates the complete one round.

While the above-mentioned type selection operation is conducted, the drive wheel shaft 14 is driven to rotate through the use of the partial gear 152 included in the drive wheel gear 15 and the partial gear 122 included in the cam gear 12 as shown in FIG. 3(A). After completion of the type selection operation, through the use of the cam groove 31, the lever 29 is driven to swing in the counter-clockwise direction around the drive wheel shaft 14, whereby the selected types make contact with the copy paper disposed below the hand-held printer through the aperture 2. The broken line in FIG. 4 shows a condition where the print impact operation is conducted.

After completion of the print impact operation, the drive wheel shaft 14 is driven to rotate in the reverse direction as shown in FIG. 3(B). At the same time, the energization of the electro-magnetic control system 19 is released. The protrusion 26 formed in the drive wheel 27 hits the tip end of the lever 23 for releasing the lever 23 from the click portion 20. Accordingly, the entire drive wheels 27 rotate in the reverse direction in response to the rotation of the drive wheel shaft 14 to return to the initial stand-by condition. At this moment, the lever 29 is driven to swing in the clockwise direction around the drive wheel shaft 14 due to the cam groove 31 formed in the side wall of the cam gear 12. Thus, the idle wheels 28 and the type carrying belts 30 swing in the clockwise direction to return to the initial position. A suitable detection unit is provided for detecting the rotation of the drive wheel shaft 14 in order to develop a control signal to stop the rotation of the motor 8. It will be clear that the above-mentioned sequence of the operation is conducted while the motor 8 rotates the complete one round.

Figure 5:
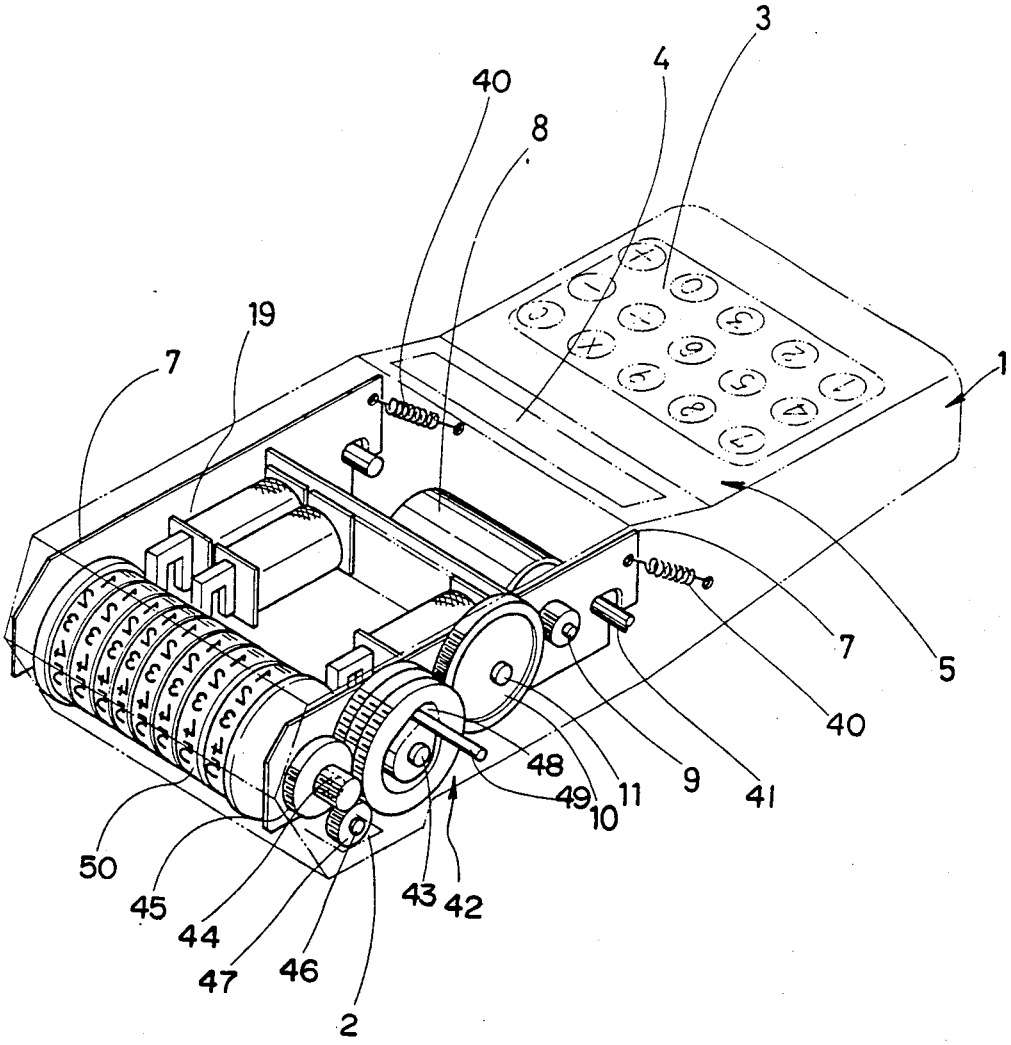
FIG. 5 is a perspective view of another embodiment of a hand-held printer of the present invention.

FIG. 5 shows another embodiment of the hand-held printer of the present invention, which employs type wheels instead of the type carrying belts. Like elements corresponding to those of FIGS. 1 through 4 are indicated by like numerals.

The printer mechanism section is secured to the housing 1 via a spring 40 in a manner that the printer mechanism section performs a swinging movement around a shaft 41. The printer mechanism section comprises the motor, the motor rotation transfer means, type wheels, and stoppers for stopping the rotation of the type wheels.

The motor gear 9 is secured to the shaft of the motor 8. The idle gear 10 is geared to the motor gear 9. A cam gear 42, which is rotatably supported by a pin 43 secured to the frame 7, is geared to the idle gear 10. A type wheel gear 45 secured to a type wheel shaft 44 is geared to the cam gear 42. Further, a reset gear 47 rotatably supported by a pin 46 fixed to the frame 7 is geared to the type wheel gear 45 and the cam gear 42.

The cam gear 42 comprises a composite gear including one full gear and two partial gears. The type wheel gear 45 comprises a composite gear including one full gear and one partial gear. More specifically, the cam gear 42 is geared to the idle gear 10 through the use of the full gear included in the cam gear 42. The type wheel gear 45 is geared to the cam gear 42 through the use of one of the two partial gears included in the cam gear 42 and the partial gear included in the type wheel gear 45. The reset gear 47 is geared to the cam gear 42 via the other partial gear included in the cam gear 42. These gears function to selectively transfer the rotation of the motor 8 to the type wheel shaft 44.

At the side wall of one of the two partial gears included in the cam gear 42, a cam groove 48 is formed, to which a pin 49 fixed to the body of the hand-held printer is accommodated. Therefore, the printer mechanism section is swung around the shaft 41 while the cam gear 42 rotates one round. That is, the gears function not only to rotate the type wheel shaft 44 but also to perform the type impact operation.

A plurality of type wheels 50 are rotatably mounted on the type wheel shaft 44 in a manner that each of the type wheels are controlled to stop its rotation, independently, without regard to the rotation of the type wheel shaft 44. The electro-magnetic control system 19 controls the stopping operation of the rotation of the type wheels 50. More specifically, the type wheel 50 rotates when the motor 8 begins to rotate. When a desired type reaches a preselected position suited for the following type impact operation, the electro-magnetic control system 19 is enabled to stop the rotation of the type wheel 50. Then, the printer mechanism section is driven to swing in the counter-clockwise direction around the shaft 41 by means of the cam gear 42. Thus, the desired type makes contact with the copy paper disposed below the aperture 2. After completion of the type impact operation, the printer mechanism section is driven to swing in the clockwise direction around the shaft 41 by means of the cam gear 42. Further, at the same time, the reset gear 47 is geared to the cam gear 42 to rotate the type wheels 50 in the reverse direction, thereby returning the type wheels 50 to their initial stand-by condition. The above-mentioned set of operations is sequentially conducted while the motor 8 rotates the complete one round. As already discussed, the driving signal for the motor 8, and the control signal for the electro-magnetic control system 19 are developed from a control system included in the hand-held printer.

Figure 6:
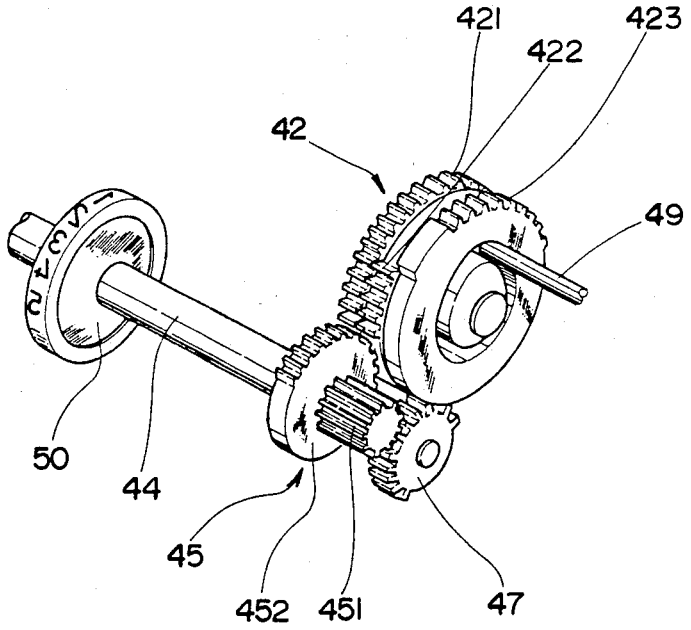
FIG. 6 is a perspective view showing the relationship between a cam gear and a type wheel gear included in the hand-held printer of FIG. 5.

FIG. 6 shows the relationship between the cam gear 42 and the type wheel gear 45. The cam gear 42 comprises a composite gear including a full gear 421, and partial gears 422 and 423. The type wheel gear 45 comprises a composite gear including a full gear 451 and a partial gear 452. The partial gear 422 included in the cam gear 42 is located at the position suited for gearing to the partial gear 452 included in the type wheel gear 45.

When the entire type wheels 50 are held in the initial stand-by position, the partial gear 422 is geared to the partial gear 452 for preparing the rotation. At this moment, the reset gear 47 is not geared to the partial gear 423 included in the cam gear 42. The geared sections of the partial gears 422 and 452 have a length for rotating the type wheel shaft 44 by one round. The non-geared sections of the reset gear 47 and the partial gear 423 have a length corresponding to the above-mentioned length of the geared sections of the partial gears 422 and 452 so that the reset gear 47 is geared to the partial gear 423 when the partial gear 452 is released from the partial gear 422. The geared sections of the reset gear 47 and the partial gear 423 have a length for rotating the type wheel shaft 44 by the one round. When the reset gear 47 is geared to the partial gear 423, the partial gear 452 is released from the partial gear 422.

Figure 7:
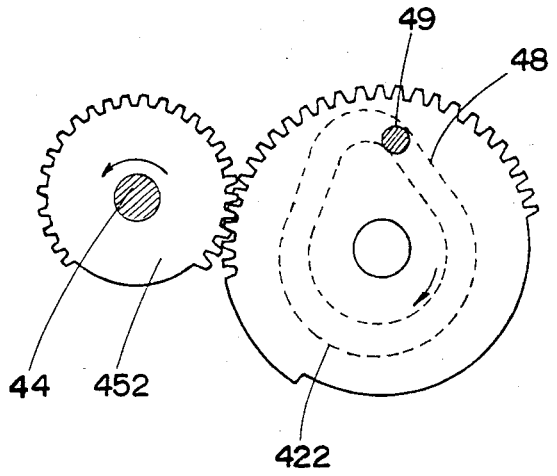
FIGS. 7(A) and 7(B) are side views for explaining the operation modes of the cam gear and the type wheel gear of FIG. 6.
Figure 7:
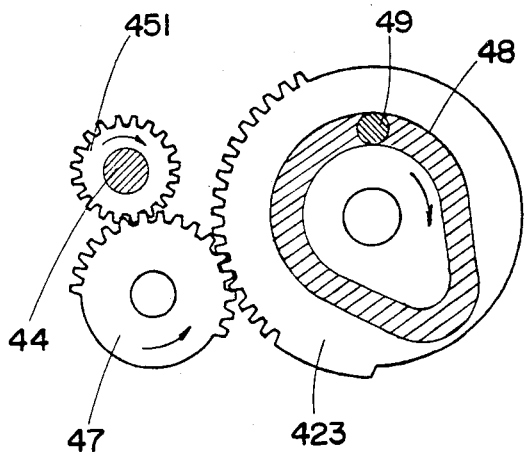

The type wheel shaft 44 is driven to rotate in the forward direction when the partial gear 452 included in the type wheel gear 45 is geared to the partial gear 422 included in the cam gear 42. Contrarily, the type wheel shaft 44 is driven to rotate in the reverse direction when the reset gear 47 is geared to the partial gear 423 included in the cam gear 42. FIG. 7(A) shows a condition where the type wheel shaft 44 is driven to rotate in the forward direction, and FIG. 7(B) shows a condition where the type wheel shaft 44 is driven to rotate in the reverse direction. After completion of the type selection operation, the printer mechanism section is driven to swing in the counter-clockwise direction around the shaft 41 by means of the pin 49 accommodated in the cam groove 48. And, after completion of the type impact operation, the printer mechanism section is driven to swing in the clockwise direction as is clear from FIGS. 7(A) and 7(B). The swinging operation is also conducted through the use of the rotation of the motor 8.

Figure 8:
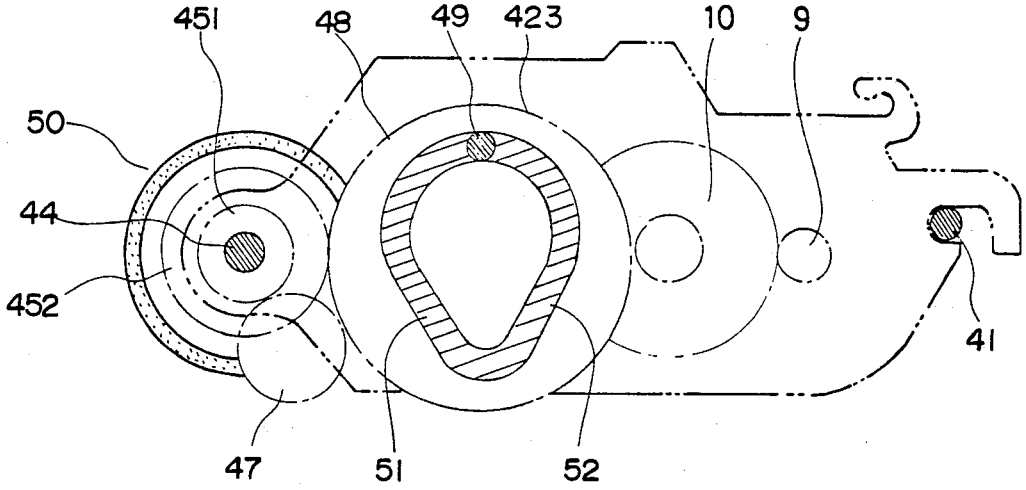
FIG. 8 is a side view showing the relationship between gears and a cam groove included in the hand-held printer of FIG. 5.

FIG. 8 shows the relationship between the gears and the cam groove 48 in the initial stand-by condition. The pin 49 travels along a left side groove 51 of the cam groove 48 before the type impact operation is conducted, and travels along a right side groove 52 of the cam groove 48 after completion of the type impact operation.

Figure 9:
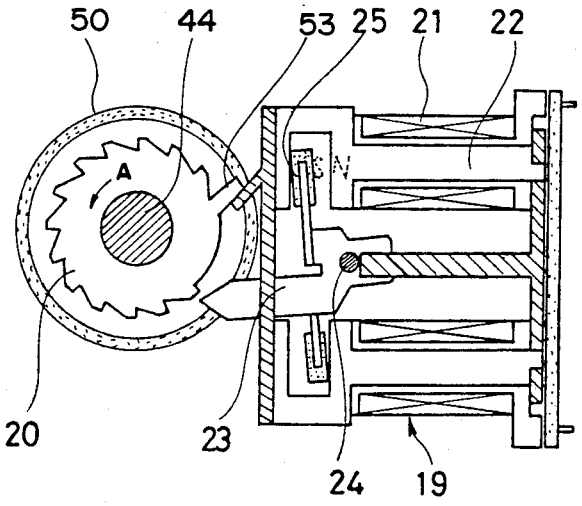
FIG. 9 is a sectional view showing the relationship between a type wheel and an electromagnetic control system included in the hand-held printer of FIG. 5.

FIG. 9 shows the relationship between the type wheel 50 and the electro-magnetic control system 19. The electromagnetic control system 19 functions to stop the rotation of the type wheel 50 while the type wheel 50 rotates in the forward direction around the type wheel shaft 44. FIG. 9 shows a condition where the type wheel 50 is held in the initial stand-by condition.

A protrusion 53 is formed on the click portion 20 so that the protrusion 53 hits the tip end of the lever 23 when the click portion 20 rotates in the reverse direction, namely, in the clockwise direction, thereby releasing the click portion 20 from the engagement of the lever 23. The remaining construction and the operation mode are similar to that described with reference to FIG. 4.

Figure 10:
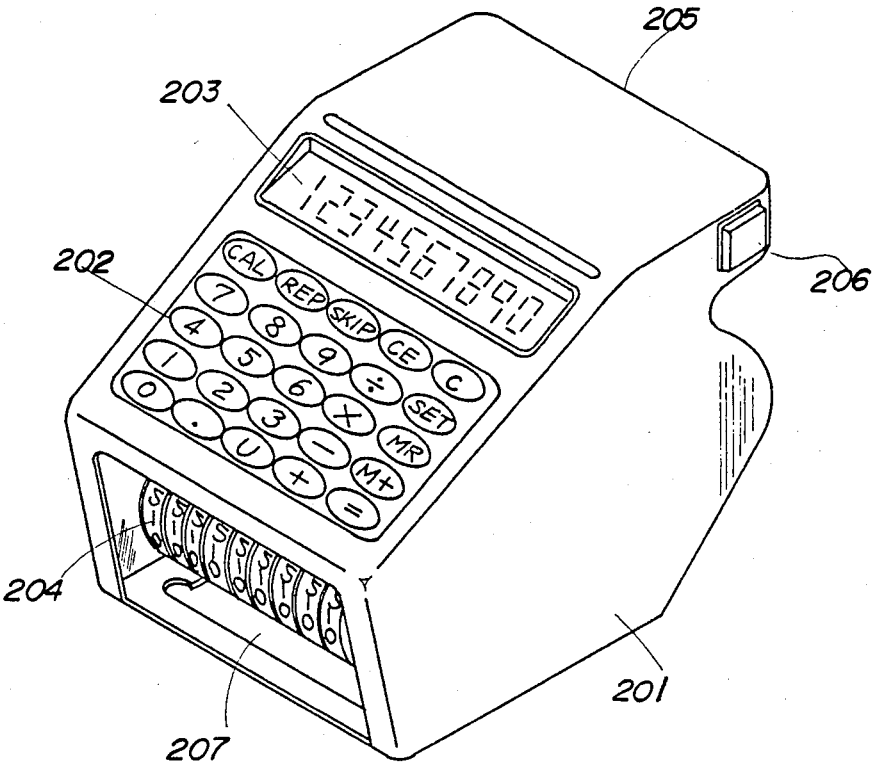
FIG. 10 is a perspective view of still another embodiment of a hand-held printer of the present invention.

FIG. 10 shows still another embodiment of the hand-held printer of the present invention. This embodiment is suited for a numbering machine.

A housing 201 includes a keyboard panel 202 for introducing a numerical data and an operation command, a digital display unit 203 for displaying the print data, and an aperture 207 through which types make contact with the print paper disposed below the hand-held printer.

A plurarily of type wheels 204 are disposed in the housing 201. A grip portion 205 is formed in the rear section of the housing 201, and a print switch 206 is secured to the side wall of the grip portion 205. The print switch 206 instructs the swing movement of the type wheels 204.

Figure 11:
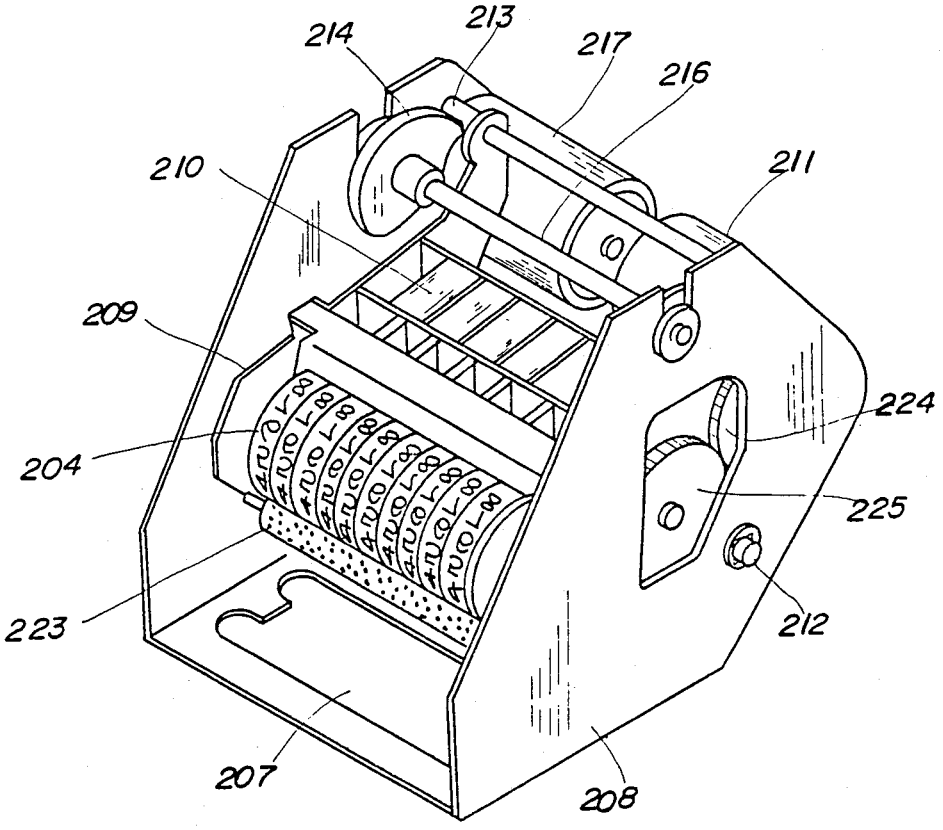
FIG. 11 is a perspective view showing the internal construction of the hand-held printer of FIG. 10.

FIG. 11 shows the internal construction of the hand-held printer of FIG. 10. A chassis 208 is disposed in the housing 201 to support a frame 209. A type selection unit 210 and a motor 211 are supported by the frame 209. The frame 209 is rotatably secured to the chassis 208 through the use of a shaft 212 so that the selected type mounted on the type wheel 204 contacts the print paper through the aperture 207 when the frame 209 is rotated in the counter-clockwise direction around the shaft 212. A cam follower shaft 213 is secured to the other end of the frame 209. The frame 209 is biased by a spring 215 (FIG. 13) so that the cam follower shaft 213 follows a cam 214. The cam 214 is rotatably mounted on a shaft 216 which is secured to the chassis 208 at the position confronting the cam follower shaft 213.

Figure 12:
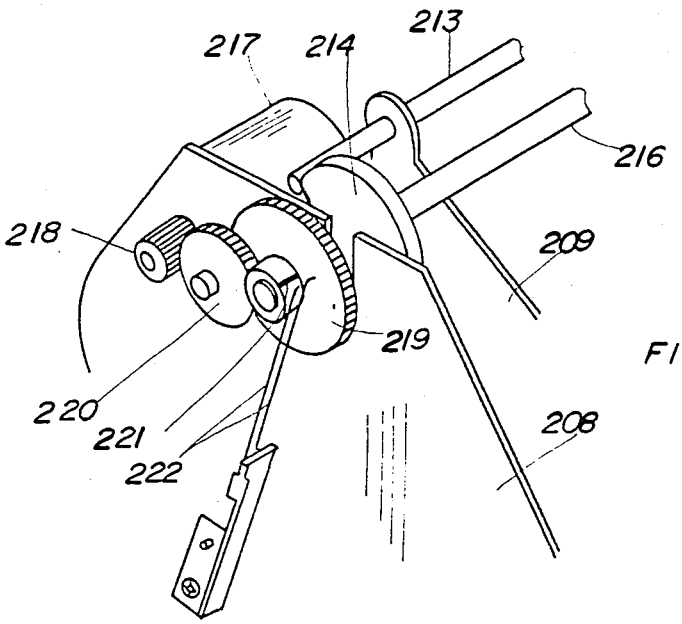
FIG. 12 is a perspective view of an essential part of the hand-held printer of FIG. 10.

A cam motor 217 is associated with the print switch 206. As shown in FIG. 12, the rotation of the cam motor 217 is transferred to the shaft 216 via a motor gear 218 secured to the shaft of the cam motor 217, a cam gear 219 secured to the shaft 216, and an idle gear 220. A contact 221 is formed on the boss of the cam gear 219 secured to the shaft 216. A detection electrode 222 is correlated with the contact 221 so that the rotation of the cam motor 217 is terminated when the detection electrode 222 contacts the contact 221. That is, the cam 214 is held in the initial position after completion of the one round rotation.

Figure 13:
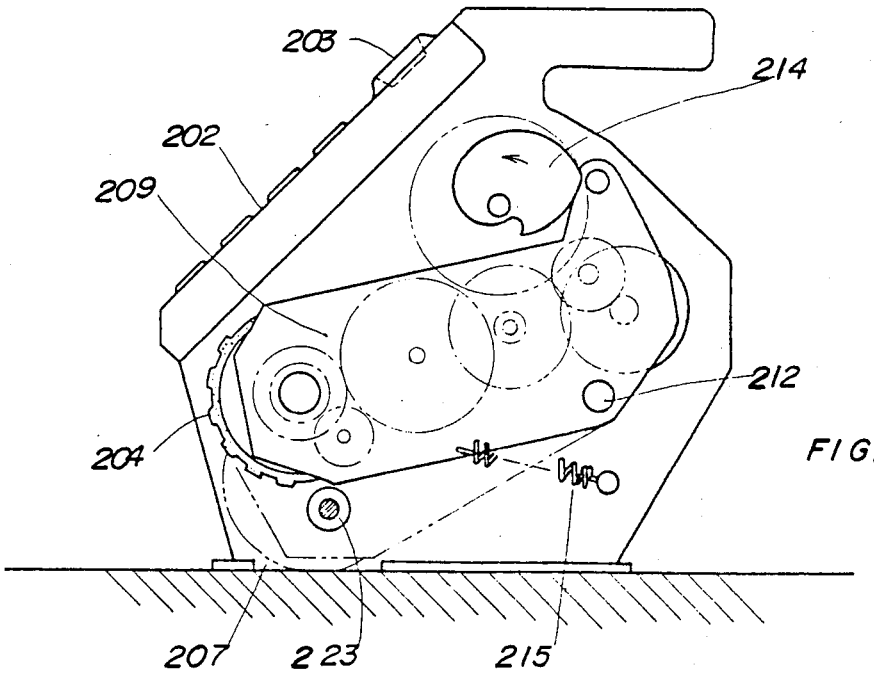
FIG. 13 is a side view of an essential part of the hand-held printer of FIG. 10.

An ink roller 223 confronts the type wheels 204. The ink roller 223 is spaced apart from the type wheels 204 when the type wheels 204 are held in the home position as shown in FIG. 13. When the type wheels are driven to swing downward in response to the print instruction derived from the print switch 206, the ink roller 223 contacts the selected types mounted on the type wheels 204.

Figure 14:
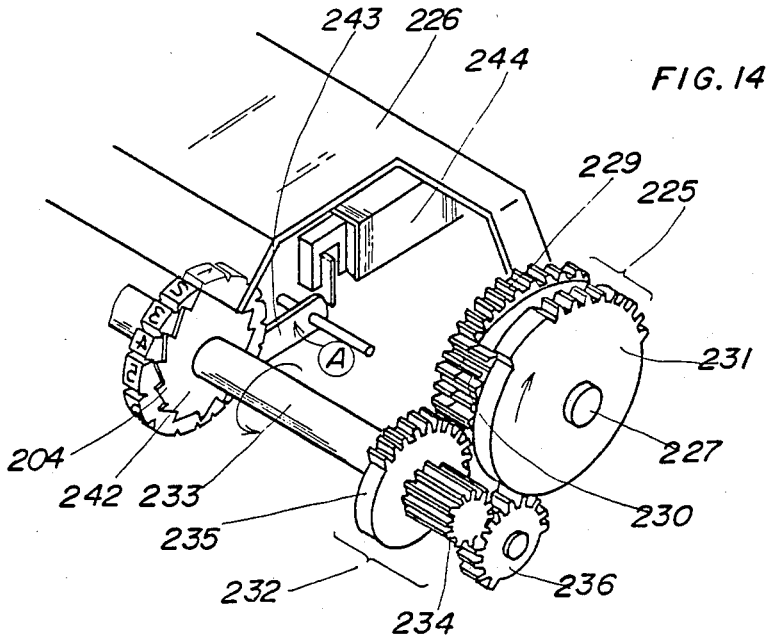
FIG. 14 is a perspective view of a type wheel lock mechanism included in the hand-held printer of FIG. 10.

An idle gear 224 and a main gear 225 function to transfer the rotation of the motor 211 to the type wheel rotation mechanism, and to activate a type wheel lock lever 226. The main gear 225 comprises, as shown in FIG. 14, a composite cam/gear including a lock mechanism drive cam 228 (FIG. 15), a full gear 229, a first partial gear 230, and a second partial gear 231 mounted on a shaft 227. The full gear 229 is geared to the idle gear 224 to receive the rotation of the motor 211.

Figure 16:
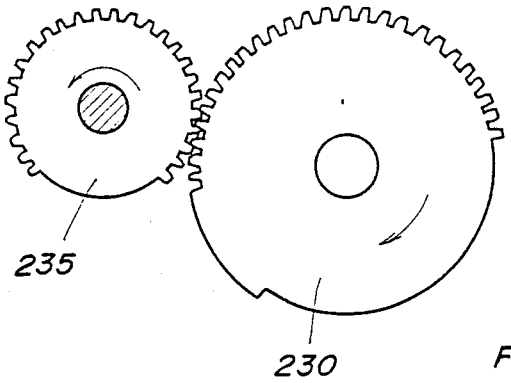
FIGS. 16(A) and 16(B) are side views for explaining the operation modes of the type wheel lock mechanism of FIG. 14.
Figure 16:
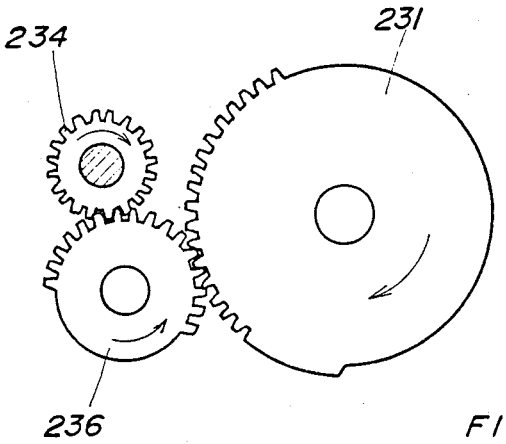

A type wheel gear 232 comprises a composite gear including a full gear 234 fixed to a drive shaft 233 of the type wheels 204, and a partial gear 235. The partial gear 235 is geared to the first partial gear 230 included in the main gear 225 as shown in FIG. 16(A). The full gear 234 is geared to a reset gear 236, which is geared to the second partial gear 231 included in the main gear 225 as shown in FIG. 16(B). The first partial gear 230 is geared to the partial gear 235 included in the type wheel gear 232 when the type wheels 204 are held in the initial stand-by condition. The geared sections of the first partial gear 230 and the partial gear 235 have a length required for rotating the drive shaft 233 by a complete one round. When the partial gear 235 is released from the first partial gear 230, the reset gear 236 is geared to the second partial gear 231 to rotate the drive shaft 233 in the reverse direction.

Figure 15:
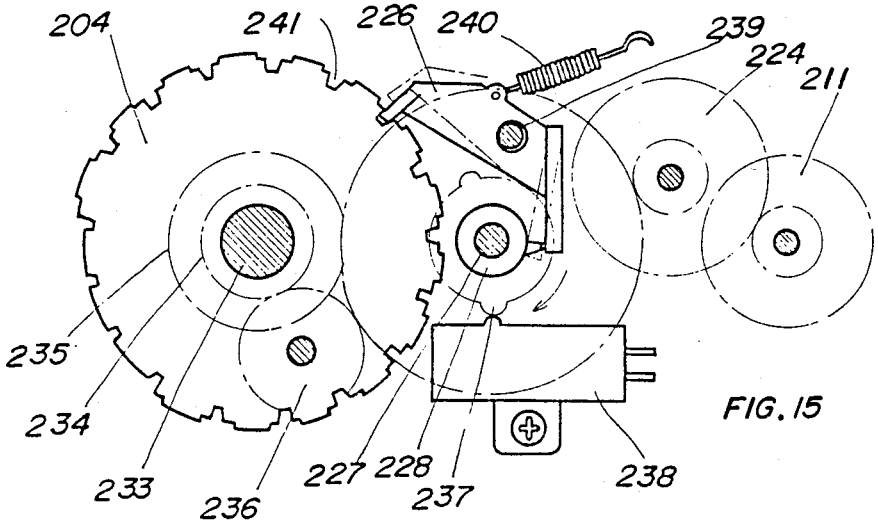
FIG. 15 is a side view of an essential part of the type wheel lock mechanism of FIG. 14.

A cam 237 is fixed to the side wall of the full gear 229 included in the main gear 225. The cam 237 includes a pair of protrusions as shown in FIG. 15 to depress a contact of a detection switch 238, thereby stopping the rotation of the motor 211.

The type wheel lock lever 226 is rotatably mounted on a shaft 239 in a manner that one end confronts the type wheels 204 and the other end confronts the lock mechanism drive cam 228. A spring 240 is secured to the type wheel lock lever 226 to bias the type wheel lock lever 226 in the clockwise direction in FIG. 15. The type wheel 204 includes V-shaped grooves 241 formed between adjacent two types, to which the end of the type wheel lock lever 226 is accommodated. Upon every rotation of the lock mechanism drive cam 228, one end of the type wheel lock lever 226 is pushed to inset the other end of the type wheel lock lever 226 into the V-shaped grooves 241.

Selection click portions 242 are secured to each of the type wheels 204 at the side wall thereof to select a desired type mounted on the type wheels 204. More specifically, an electromagnet 244 is energized in response to a control signal for rotating a selection lever 243 in a direction shown by an arrow A to catch the click, thereby stopping the rotation of the type wheel 204.

When a desired print data is introduced from the keyboard panel 202, the motor 211 begins to rotate to drive the full gear included in the main gear 225 via the idle gear 224. The first partial gear 230 included in the main gear 225 is geared to the partial gear 235 included in the type wheel gear 232 to rotate the type wheels 204 in the forward direction. While the type wheels 204 rotate in the forward direction, a desired type corresponding to the introduced print data is selected through the use of the electromagnet 244, the selection lever 243 and the click portion 242. The type selection for the entire digits is completed while the type wheel shaft 233 rotates the complete one round, namely, the main gear shaft 227 rotates a half of the complete one round. After completion of the type selection operation, the lock mechanism drive cam 228 pushes the type wheel lock lever 226 in the counter-clockwise direction around the shaft 239 to insert the end of the type wheel lock lever 226 into the V-shaped groove 241 of the type wheels 204. In this way, the types are forced to align in proper positions suited for the following type impact operation, and are locked in the proper positions. At this moment, the protrusion formed on the cam 237 actuates the switch 238 to stop the rotation of the motor 211.

Thereafter, when the print switch 206 is actuated, the print instruction is developed to rotate the cam motor 217. The cam 214 begins to rotate to swing the type wheels 204 downward under the condition where the type wheels 204 are locked not to rotate. The selected types contact the ink roller 223, and are depressed to the print paper disposed below the aperture 207 formed in the bottom wall of the housing 201 of the hand-held printer.

After completion of the type impact operation, the cam 214 functions to swing the type wheels 204 upward to return the type wheels 204 to their initial home position. Further, the motor 211 is driven to rotate to drive the main gear 225. The protrusion included in the lock mechanism drive cam 228 is released from the type wheel lock lever 226. The type wheel lock lever 226 is rotated in the clockwise direction around the shaft 239 due to the spring 240 for releasing the type wheels 204 from the locked condition. Then, the second partial gear 231 is geared to the reset gear 236 to rotate the type wheels 204 in the reverse direction, thereby returning the type wheels 204 to the initial stand-by condition.

A preferred print data control system suited for the electronic numbering machine is described in copending U.S. patent application, ELECTRONIC DATA CONTROL IN A NUMBERING MACHINE Ser. No. 227,986 filed on Jan. 23, 1981 by Takakazu Makizuka and Sunao Katoh, and assigned to the same assignee as the present application.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A hand-held printer comprising:

a housing including an aperture formed in the bottom wall thereof;

a plurality of type carrying means for carrying a plurality of types mounted thereon, said plurality of type carrying means confronting said aperture formed in said housing;

first drive means for rotating said plurality of type carrying means in a first direction;

type selection means for stopping the rotation of said type carrying means when a desired type reaches a preselected position confronting said aperture while said type carrying means is driven to rotate in said first direction;

frame means for operatively retaining said plurality of type carrying means in a side-by-side relationship, said frame means being swingably mounted relative to said housing between a first position wherein said type selection means stops said type carrying means when a desired type reaches a Preselected position and a second position wherein said preselected types contact a record receiving means disposed below said housing through said aperture formed in said housing;

second drive means for shifting said frame means and said plurality of said type carrying means in a swinging motion downwardly from said first position where said selection operation is conducted to said second position where the preselected types make contact with said record receiving means; and timing means for activating said second drive means after said type selection means completes said type selection operation to swing said frame and said plurality of said type carrying means downwardly wherein all of said preselected types automatically contact said record receiving means.

2. A hand-held printer according to claim 1, wherein said second drive means comprises a cam mechanism for swinging said type carrying means between said first position and said second position.

3. A hand-held printer according to claim 2, wherein said frame means is swingably mounted about a shaft and includes a pin mounted on one end thereof, said pin being operatively engaged with said cam mechanism to guide said frame means between said first and second positions.

4. A hand-held printer according to claim 1 or 2, further comprising:

reset means for rotating said plurality of type carrying means in a second direction counter to said first direction; and reset timing means for activating said reset means after said preselected types make contact with said record receiving means, thereby returning said plurality of type carrying means to the initial stand-by condition.

5. A hand-held printer according to claim 3, wherein said plurality of type carrying means comprise a plurality of type carrying belts, each of said plurality of type carrying belts carries a plurality of types mounted thereon and being independently subject to said type selection means.

6. A hand-held printer according to claim 3, wherein said plurality of type carrying means comprise a plurality of type wheels, each of said plurality of type wheels carries a plurality of types mounted thereon and being independently subject to said type selection means.

7. A hand-held printer according to claim 5, further comprising:

lock means for locking the rotation of said type wheels;

lock timing means for activating said lock means after completion of said type selection operation conducted by said type selection means; and first drive timing means for disabling said first drive means in response to said activation of said lock means.

8. The hand-held printer according to claim 6, further comprising:

a keyboard panel disposed on the upper surface of said housing for introducing a desired print data into said hand-held printer; and a digital display unit for displaying said print data.

9. A hand-held printer according to claim 7, wherein said type selection means comprises an electromagnetic system for holding said type wheels when a desired type reaches said preselected position confronting said aperture.

10. A hand-held printer according to claim 1, wherein each of said plurality of type carrying means is operatively mounted on a drive wheel and is operatively connected to a locking means for selectively locking the rotation of individual type carrying means, said locking means including a lever operatively engageable with a click portion of a said drive wheel to preclude rotation of said drive wheel upon selection of a preselected type.

* * * * *